US011084178B2

(12) United States Patent
Huang

(10) Patent No.: US 11,084,178 B2
(45) Date of Patent: Aug. 10, 2021

(54) BOX CUTTER

(71) Applicant: INDUSTRO INTERNATIONAL CO., LTD., Taichung (TW)

(72) Inventor: Kuo-Chan Huang, Taichung (TW)

(73) Assignee: INDUSTRO INTERNATIONAL CO., LTD., Taichung (TW)

( * ) Notice: Subject to any disclaimer, the term of this patent is extended or adjusted under 35 U.S.C. 154(b) by 0 days.

(21) Appl. No.: 16/591,630

(22) Filed: Oct. 3, 2019

(65) Prior Publication Data

US 2021/0101298 A1 Apr. 8, 2021

(51) Int. Cl.
*B26B 5/00* (2006.01)

(52) U.S. Cl.
CPC ..... *B26B 5/003* (2013.01); *B26B 5/005* (2013.01)

(58) Field of Classification Search
CPC ..... B26B 1/08; B26B 5/001; B26B 5/003; B26B 5/005
USPC ..... 30/162
See application file for complete search history.

(56) References Cited

U.S. PATENT DOCUMENTS 3,641,667 A * 2/1972 Leopoldi ..... B26B 5/005 30/2
4,683,656 A * 8/1987 Peyrot ..... B26B 5/003 30/162
4,713,885 A * 12/1987 Keklak ..... B26B 5/003 30/162
4,757,612 A * 7/1988 Peyrot ..... B26B 29/02 30/151
5,303,474 A * 4/1994 Keklak ..... B26B 5/003 30/162
5,426,855 A * 6/1995 Keklak ..... B26B 5/003 30/162
6,643,936 B2 * 11/2003 Carlson ..... B26B 25/005 30/162
6,813,833 B2 * 11/2004 Saunders ..... B26B 5/003 30/162
7,322,110 B2 * 1/2008 Hernandez ..... B26B 5/001 30/162
8,056,241 B2 * 11/2011 Davis ..... B26B 5/003 30/162
8,122,605 B2 * 2/2012 Votolato ..... B26B 5/003 30/2
8,220,160 B2 * 7/2012 Davis ..... B26B 3/06 30/162
8,250,764 B2 * 8/2012 Davis ..... B26B 5/003 30/162
8,307,556 B2 * 11/2012 Davis ..... B26B 5/003 30/162

(Continued)

*Primary Examiner* — Jason Daniel Prone
(74) *Attorney, Agent, or Firm* — Bruce Stone LLP; Joseph A. Bruce

(57) ABSTRACT

A box cutter includes a handle, a holder and a linkage. The handle includes a front slot in communication with a space. The holder is formed with a boss and operable for holding a portion of a blade. The linkage includes a sliding element formed with a pusher. The linkage is operable to move the sliding element toward the holder to abut the pusher against the boss to move the holder toward the front slot to extend a pointed end of the blade from the space through the front slot when the boss is located between the front slot and the pusher. The pusher is biased from the boss to allow the holder to return to its original position when the pusher is located between the front slot and the boss.

7 Claims, 17 Drawing Sheets

(56) References Cited

U.S. PATENT DOCUMENTS 8,347,509 B2 * 1/2013 Votolato ..... B26B 5/00 30/151
8,353,109 B2 * 1/2013 Rohrbach ..... B26B 5/003 30/162
8,561,305 B2 * 10/2013 Davis ..... B26B 5/003 30/162
8,776,380 B1 * 7/2014 Quimby ..... B26B 5/003 30/156
8,931,180 B2 * 1/2015 Davis ..... B26B 5/003 30/162
9,808,941 B2 * 11/2017 Jacobs ..... B26B 5/001
9,908,247 B2 * 3/2018 Herlitz ..... B26B 5/001
10,245,736 B2 * 4/2019 Huang ..... B26B 5/001
10,583,572 B2 * 3/2020 Herlitz ..... B26B 5/001
10,994,429 B2 * 5/2021 Wang ..... B26B 1/08
2002/0124418 A1 * 9/2002 Votolato ..... B26B 5/001 30/294
2004/0237312 A1 * 12/2004 Hernandez ..... B26B 5/003 30/162
2008/0163493 A1 * 7/2008 Votolato ..... B26B 5/003 30/154
2008/0282547 A1 * 11/2008 Leger ..... B26B 1/08 30/162
2011/0041345 A1 * 2/2011 Austin ..... B26B 5/001 30/162
2011/0119925 A1 * 5/2011 Rohrbach ..... B26B 5/003 30/158
2011/0302787 A1 * 12/2011 Rohrbach ..... B26B 5/001 30/162
2013/0185943 A1 * 7/2013 Landwehr ..... B26B 29/02 30/153
2013/0239415 A1 * 9/2013 Wagner ..... B26B 1/08 30/162
2016/0279811 A1 * 9/2016 Huang ..... B26B 1/08
2016/0325442 A1 * 11/2016 Herlitz ..... B26B 1/08
2019/0193288 A1 * 6/2019 Hooper ..... B26B 5/005
2020/0023528 A1 * 1/2020 Rohrbach ..... B26B 5/001
2020/0055202 A1 * 2/2020 Gomez ..... B26B 5/003
2020/0338767 A1 * 10/2020 Rohrbach ..... B26B 5/003
2021/0053242 A1 * 2/2021 Seferi ..... B26B 5/003
2021/0053243 A1 * 2/2021 Seferi ..... B26B 5/003

* cited by examiner

BOX CUTTER

BACKGROUND OF INVENTION

1. Field of Invention

The present invention relates to a box cutter and, more particularly, to a blade-retreating apparatus of a box cutter.

2. Related Prior Art

A conventional box cutter includes a handle, a holder and a blade. The handle includes a track. The holder is movable along the track. The blade included a blunt end connected to the holder and a sharp end movable from the shell to cut.

When the cutting is finished, the sharp end and a portion of a cutting edge of the blade are located out of the handle and might hurt a person or damage an article. The blade is withdrawn into the handle only when the holder is deliberately moved to a rear end of the handle. Hence, the operation of the box cutter is dangerous.

The present invention is therefore intended to obviate or at least alleviate the problems encountered in prior art.

SUMMARY OF INVENTION

It is the primary objective of the present invention to provide a safe-to-use box cutter.

To achieve the foregoing objective, the box cutter includes a handle, a holder and a linkage. The handle includes a front slot in communication with a space. The holder is formed with a boss and operable for holding a portion of a blade. The linkage includes a sliding element formed with a pusher. The linkage is operable to move the sliding element toward the holder to abut the pusher against the boss to move the holder toward the front slot to extend a pointed end of the blade from the space through the front slot when the boss is located between the front slot and the pusher. The pusher is biased from the boss to allow the holder to return to its original position when the pusher is located between the front slot and the boss.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
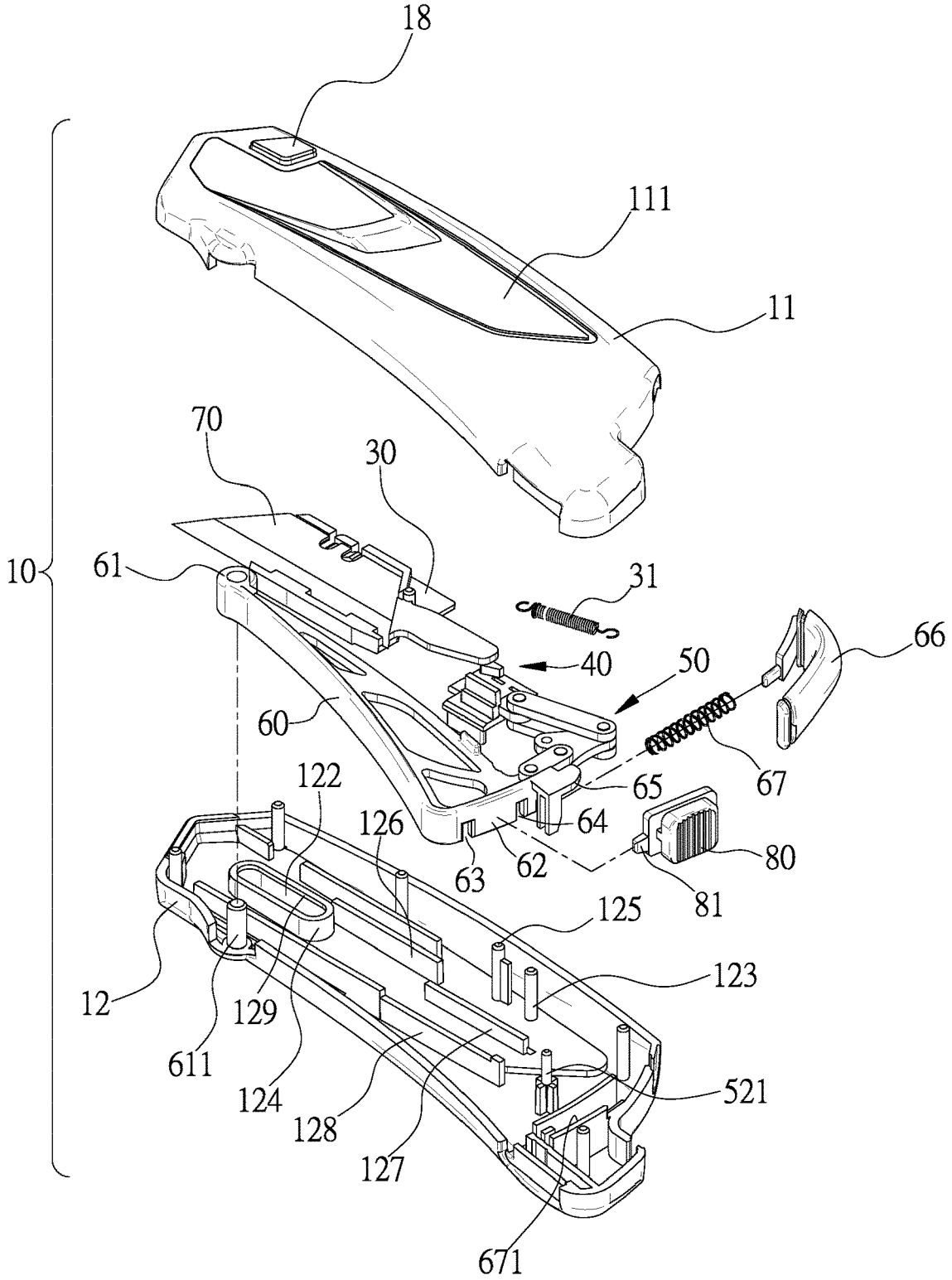
FIG. 1 is an exploded view of a box cutter according to the preferred embodiment of the present invention.
Figure 2:
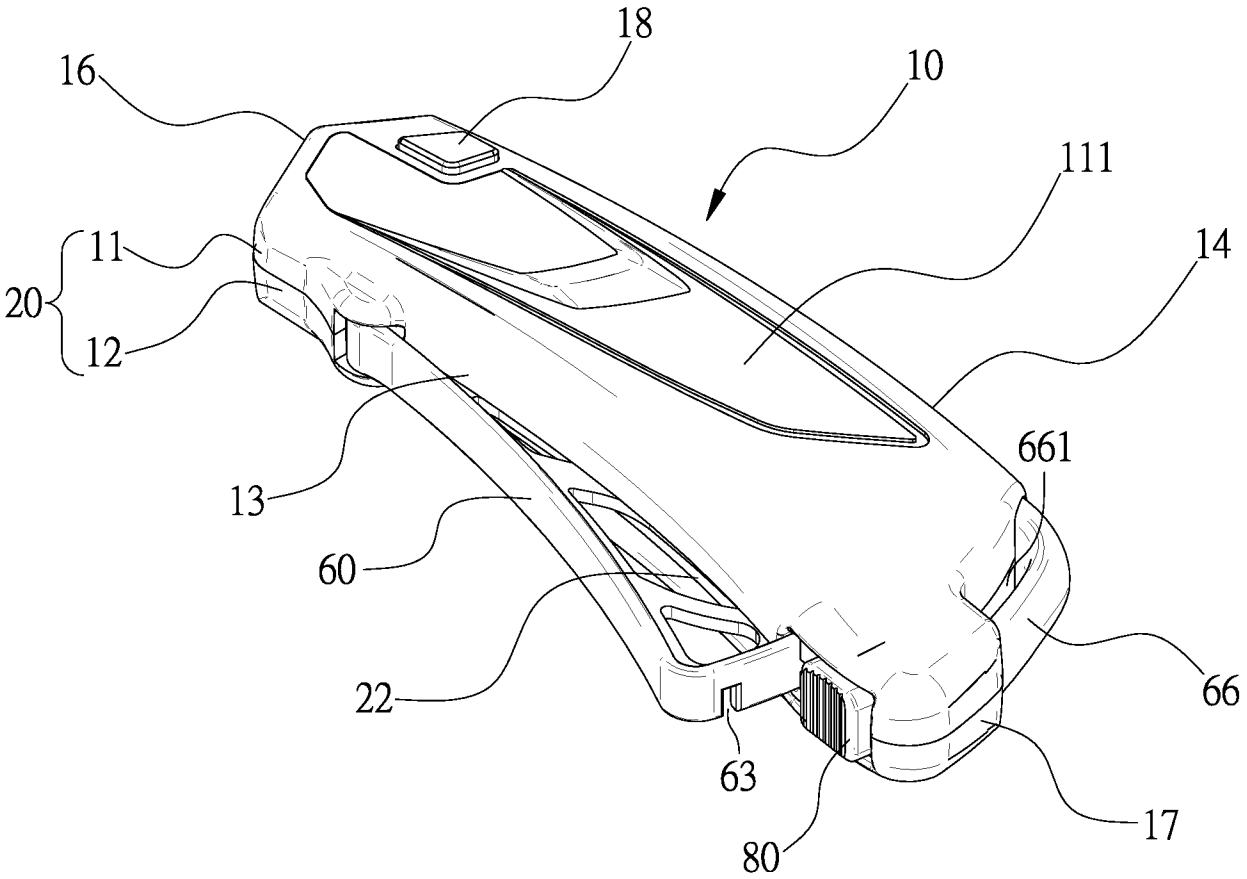
FIG. 2 is a perspective view of the box cutter shown in FIG. 1.
Figure 3:
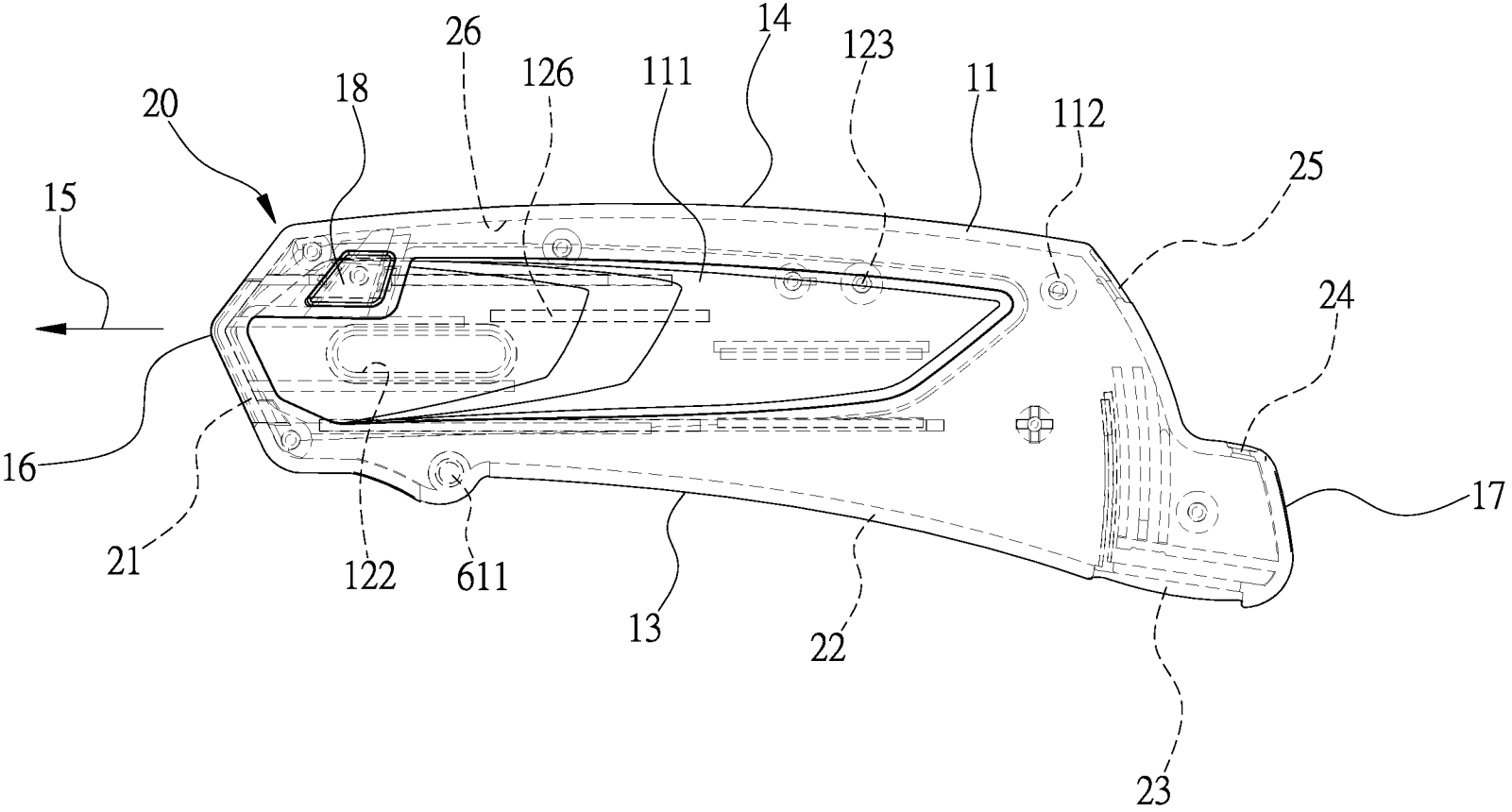
FIG. 3 is a side view of the box cutter shown in FIG. 2.

Referring to FIGS. 1 through 3, a box cutter 10 includes a hollow and elongated handle 20, a holder 30, a clutch 40, a linkage 50, a lever 60 and a blade 70 according to the preferred embodiment of the present invention. The handle 20 includes two lower slots 22 and 23 in a lower portion 13, a front slot 21 in a front end 16, two rear slots 24 and 25 in a rear end 17, and a space 26 in communication with the slots 21, 22, 23, 24 and 25. The handle 20 further includes an upper portion 14 opposite to the lower portion 13. A distance measured from the front end 16 to the rear end 17 is the length of the handle 20, i.e., the length of the box cutter 10 when the blade 70 is withdrawn in the handle 20.

The handle 20 includes two shells 11 and 12. The handle 20 includes two shells 11 and 12 that are molded separately and then joined. Referring to FIG. 3, the shell 12 is covered by the shell 11 since their profiles are identical to each other. Each of the shells 11 and 12 includes cutouts (not numbered). The cutouts of the shells 11 and 12 together become the slots 21 through 25 when the shells 11 and 12 are joined.

Figure 7:
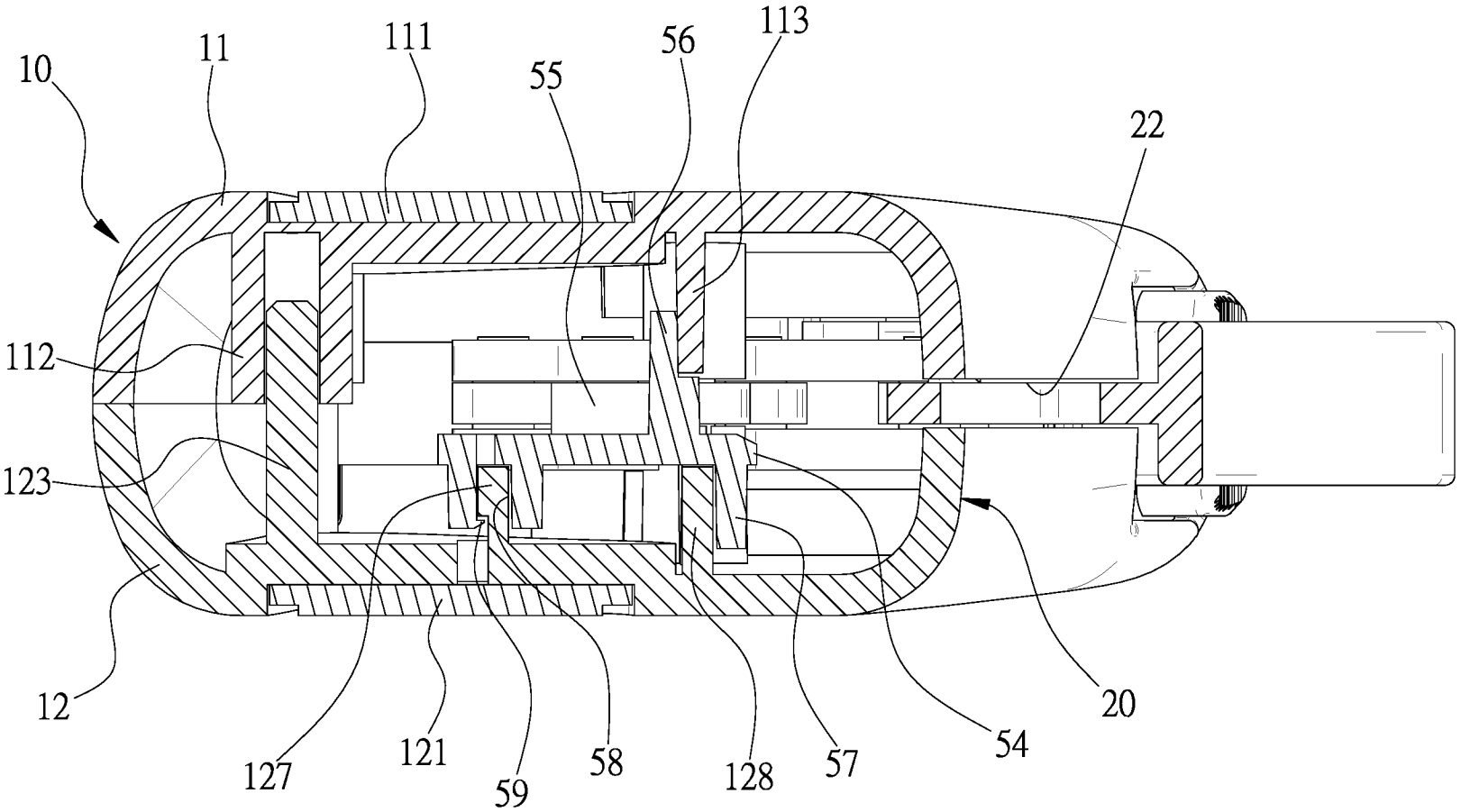
FIG. 7 is a cross-sectional view of the box cutter taken along a line B-B shown in FIG. 4.

Referring to FIG. 7, the shell 11 includes cylinders 112, and the shell 12 includes rods 123 in the preferred embodiment. However, the shell 11 can include rods 123, and the shell 12 can include cylinders 112 in another embodiment. The rods 123 are fitted in the cylinders 112 to join the shells 11 and 12. Adhesive can be provided at an interface between the shells 11 and 12 to adhere the shells 11 and 12 to each other.

The shell 12 includes, on an internal face, a protrusion 124, a stopping strip 126, a track 127 and a rib 128. The protrusion 124 extends in a loop to provide a groove 122. A flange 129 extends from an internal face of the protrusion 124.

Figure 6:
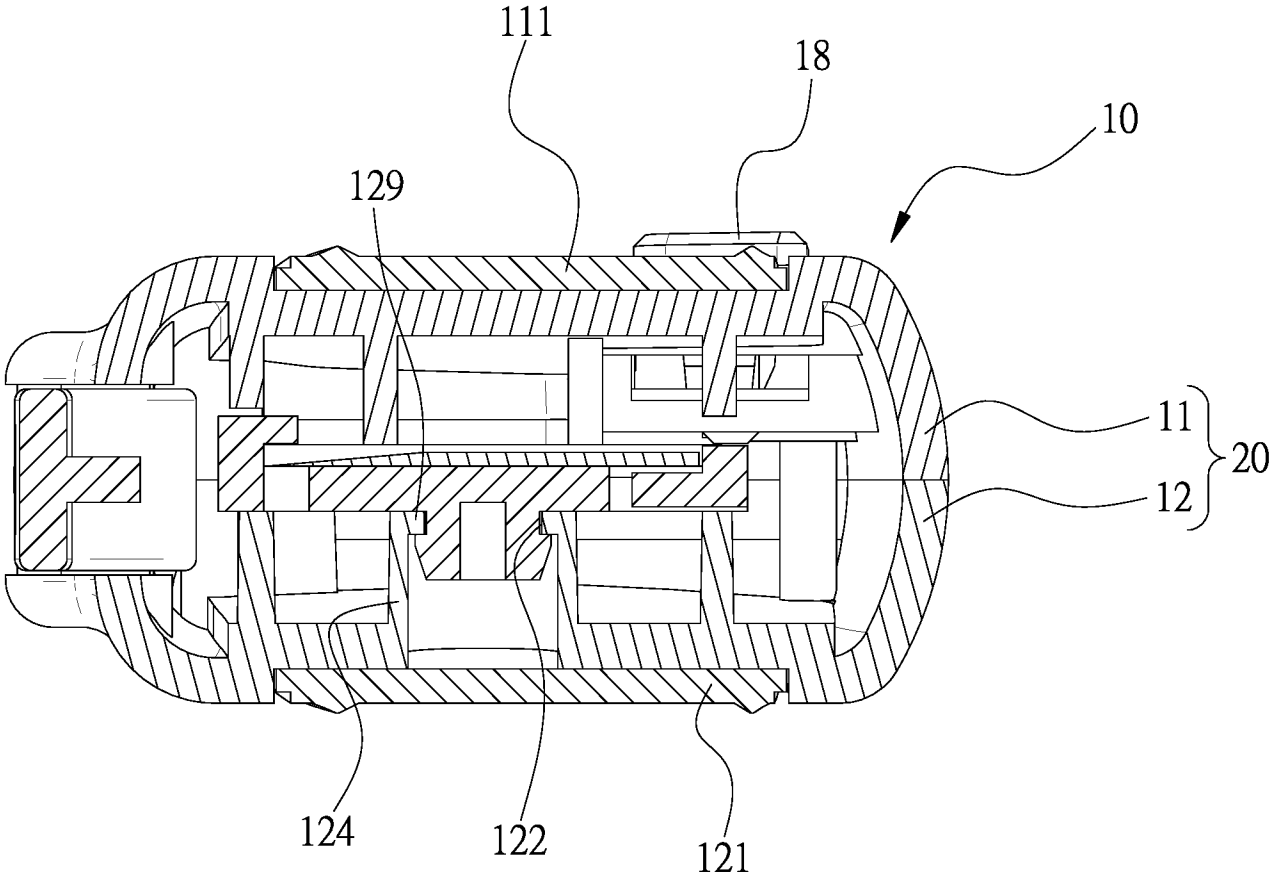
FIG. 6 is a cross-sectional view of the box cutter taken along a line A-A shown in FIG. 4.

Referring to FIGS. 1 through 3, a button 18 is located on the shell 11. A decorative strip 111 is adhered to the shell 11 for example. Referring to FIGS. 6 and 7, a decorative strip 121 is adhered to the shell 12 for example. The decorative strips 111 and 121 cover or conceal protrusions from and cavities and apertures in the shells 11 and 12. For example, the decorative strip 121 covers a groove 122 in the shell 12.

Figure 8:
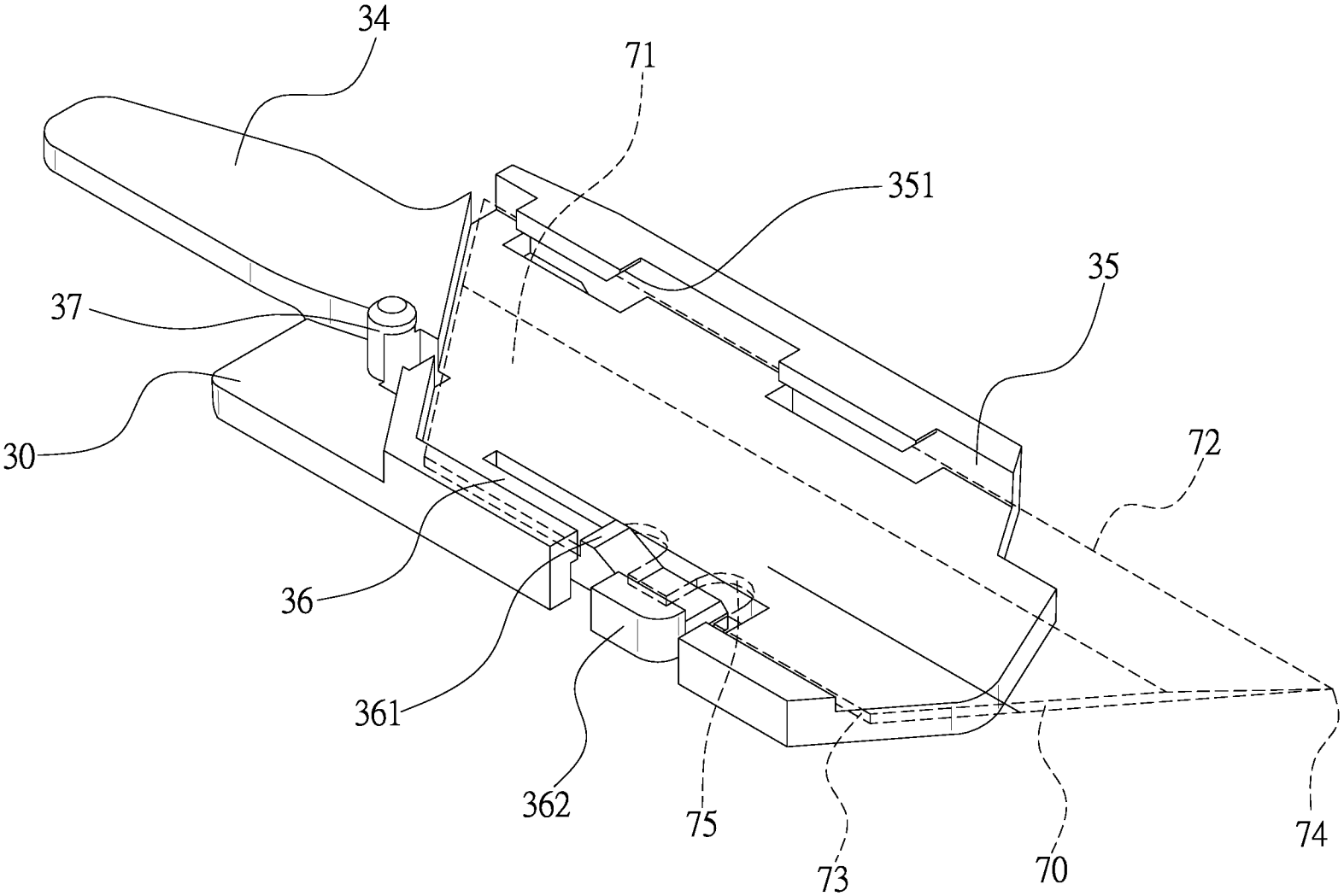
FIG. 8 is a perspective view of a blade and a holder of the box cutter shown in FIG. 1.
Figure 9:
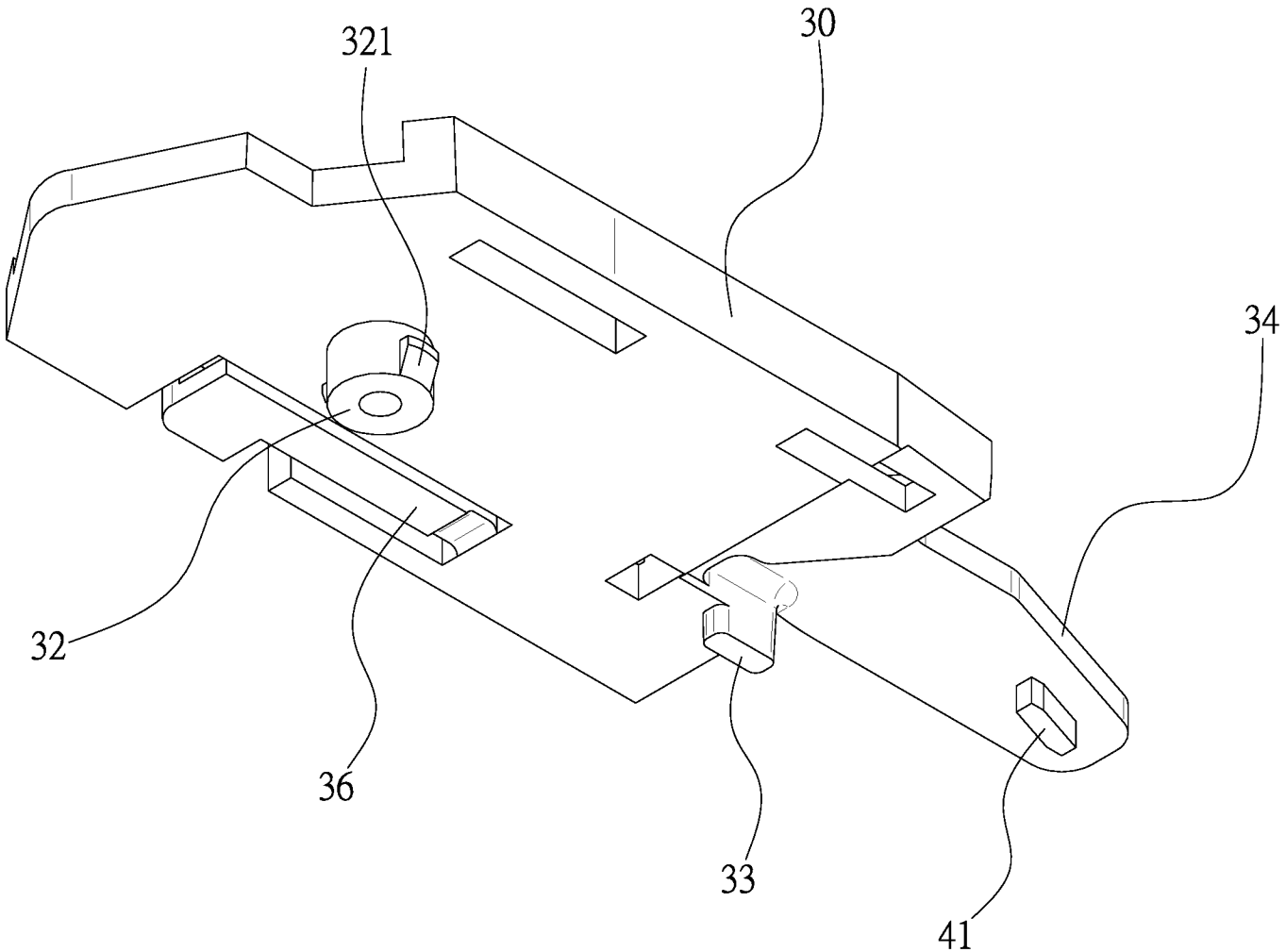
FIG. 9 is another perspective view of holder shown in FIG. 8.

Referring to FIGS. 8 and 9, the holder 30 includes a pivot 32, a block 33, a fin 34, a cavity 35, an elastic leaf 36 and a rod 37. The pivot 32 and the block 33 extend from a first face of the holder 30. The pivot 32 is formed with two barbs 321. The fin 34 extends from a rear edge of the holder 30 in the vicinity of the block 33. The cavity 35 is made in a second face of the holder 30. The holder 30 further includes two limiting portions 351 formed on the second face of the holder 30 in the vicinity of the cavity 35. The elastic leaf 36 includes a locking portion 361 extending from the second face and a driving portion 362 formed at an upper edge. The rod 37 is formed on the second face of the holder 30 in the vicinity of a portion of the holder 30 where the fin 34 meets the cavity 35.

The barbs 321 are engaged with the flange 129 as the pivot 32 is forced into the groove 122, thereby keeping the pivot 32 to the shell 12. The pivot 32 is movable along the groove 122 so that the holder 30 is movable relative to the shell 12.

A spring 31, preferably a helical spring, is arranged between the holder 30 and the shell 12. The spring 31 includes an end connected to the rod 37 and another end connected to the bar 125 so that the spring 31 tends to cause the holder 30 to slide and pivot relative to the shell 12. The spring 31 makes the holder 30 slide toward the rear end 17 of the handle 20 as the pivot 32 slides toward a rear end of the groove 122 from a front end of the groove 122. The sliding of the holder 30 relative to the shell 12 is stopped when the pivot 32 reaches the rear end of the groove 122. The pivoting of the holder 30 relative to the shell 12 about the pivot 32 is stopped when the block 33 is abutted against the stopping strip 126. Thus, the pointed end 74 of the blade 70 is directed to the front slot 21 of the handle 20. Moreover, a phantom line that passes the barbs 321 extends perpendicular to a length of the groove 122 so that the barbs 321 are firmly engaged with the flange 129 to keep the holder 30 to the shell 12 and that the pivot 32 is movable along the groove 122 to allow the holder 30 to move relative to the shell 12.

The blade 70 includes two lateral faces 71, a lower edge 72, an upper edge 73, a pointed end 74 and two cutouts 75. The lower edge 72 is a sharp edge and will be referred to as the "cutting edge 72." The upper edge 73 is a blunt edge.

A major portion of the blade 70 is inserted in the cavity 35 of the holder 30 while the pointed end 74 is located out of the cavity 35. The major portion of the blade 70 is retained in the cavity 35 by the limiting portions 351. The locking portion 361 is inserted in a selected one of the cutouts 75 in the upper edge 73 of the blade 70. The driving portion 362 is in the vicinity of the upper edge 73 of the blade 70.

Figure 4:
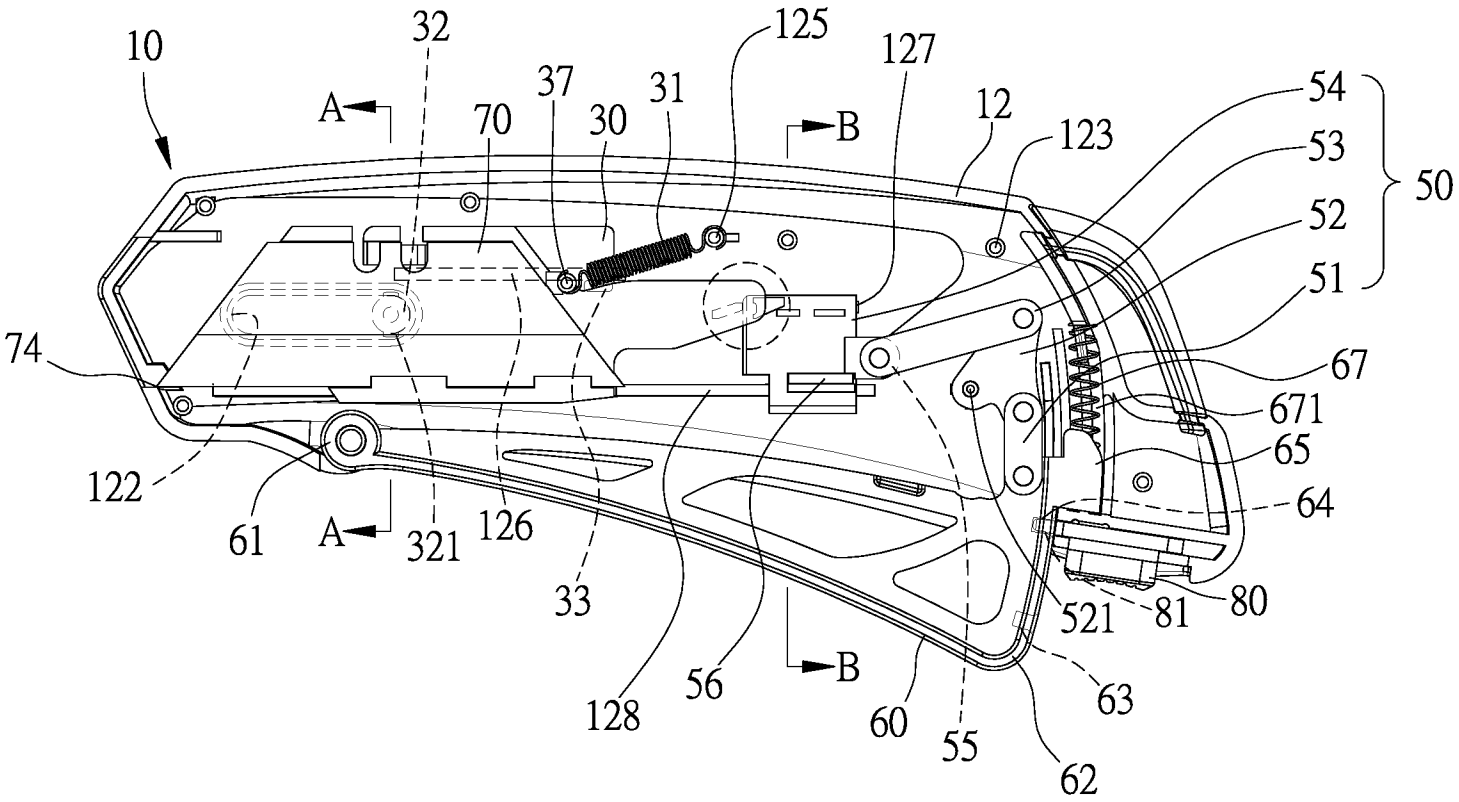
FIG. 4 is a side view of a shell and related elements of the box cutter shown in FIG. 1.

Referring to FIGS. 1 and 4, the linkage 50 includes two rocking elements 51, a crank 52, two connecting elements 53 and a sliding element 54. The crank 52 is formed with a middle pivot 521 inserted in the shell 12 so that the crank 52 is rotatable relative to the shell 12. Moreover, the crank 52 includes a lower portion located between and pivotally connected to the rocking elements 51. The crank 52 further includes an upper portion located between and pivotally connected to the connecting elements 53.

Figure 10:
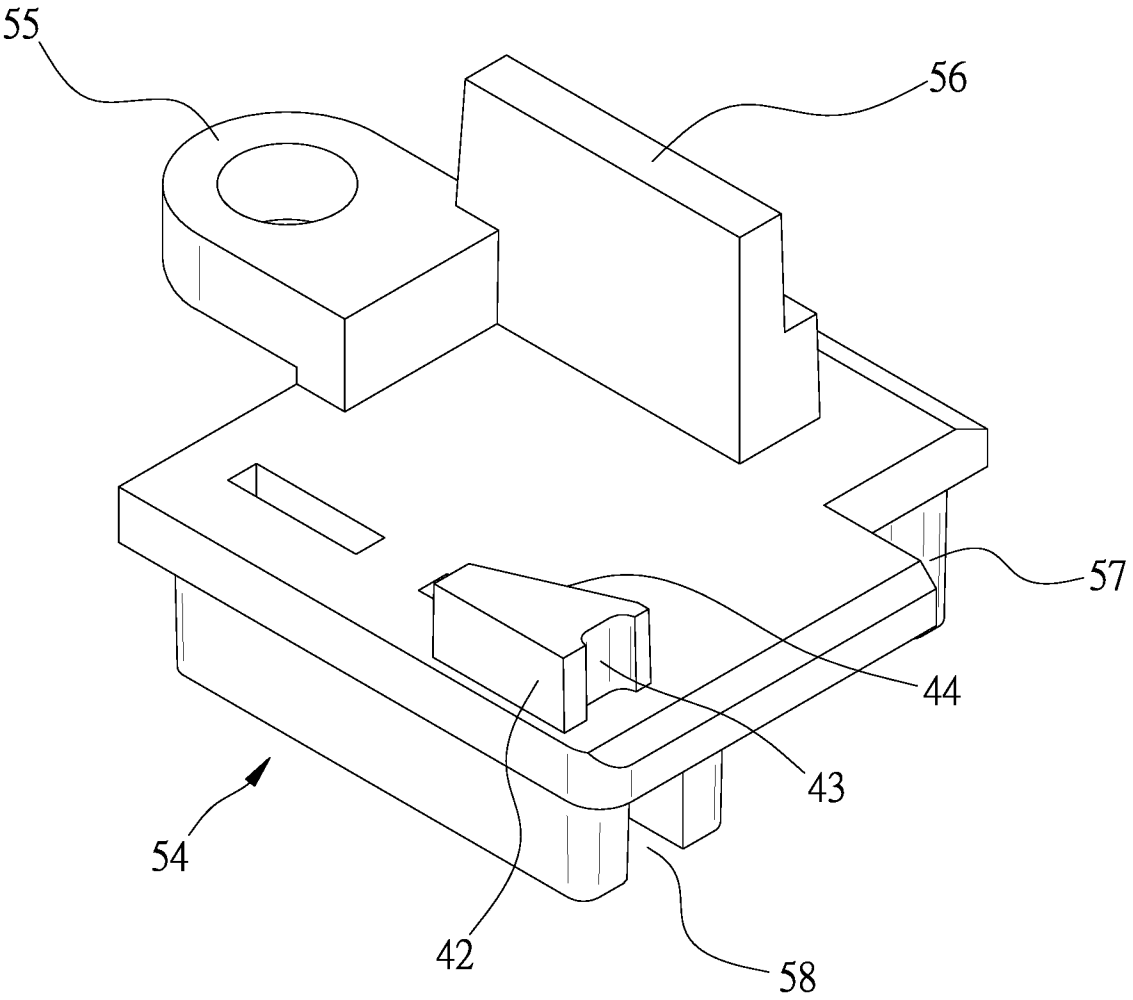
FIG. 10 is a perspective view of a sliding element of the box cutter shown in FIG. 1.

Referring to FIG. 10, the sliding element 54 includes a lug 55, two fins 56 and 57 and a groove 58. The lug 55 is located between and pivotally connected to connecting elements 53. The fins 56 and 57 extend from two opposite faces of the sliding element 54. The groove 58 is made by and between two parallel fins (not numbered) on the same face of the sliding element 54 as the fin 57. A barb 59 is formed on at least one of the fins between which the groove 58 is made.

Figure 5:
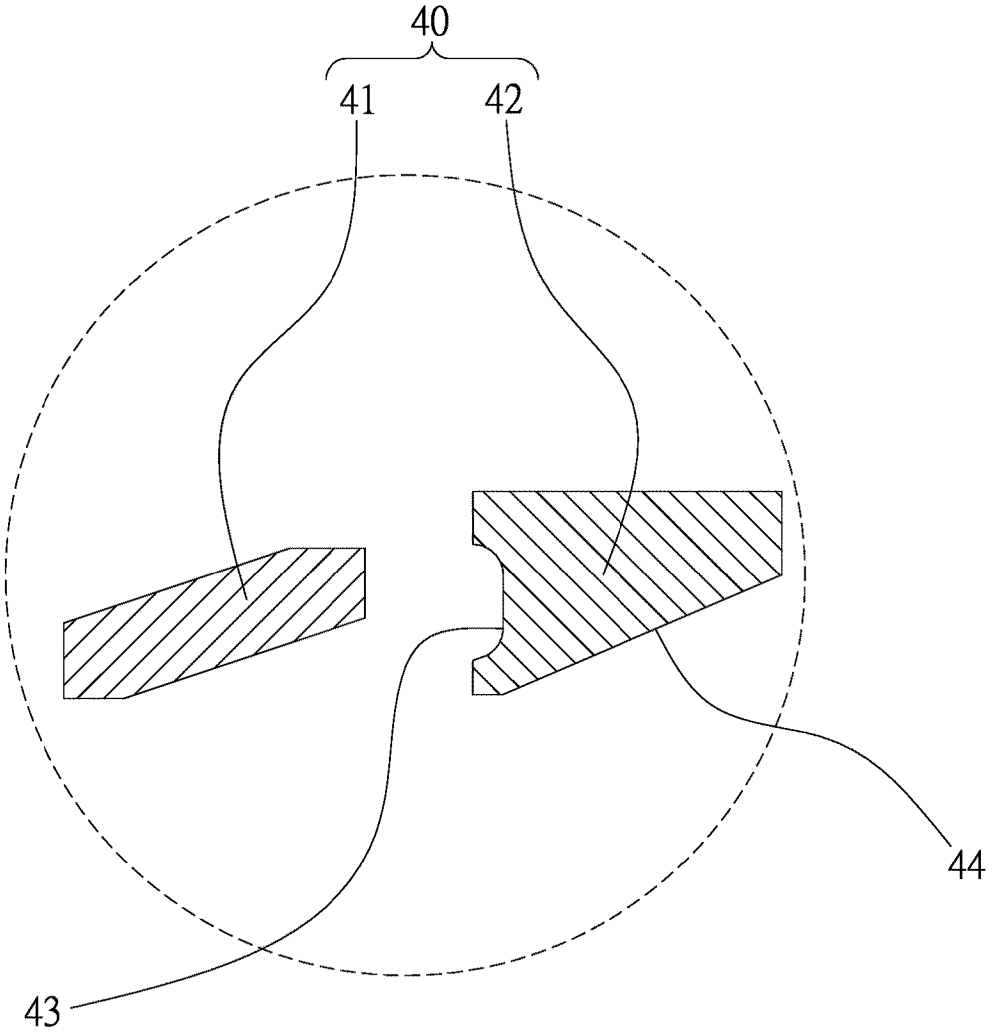
FIG. 5 is a cross-sectional view of a clutch of the box cutter shown in FIG. 1.

Referring to FIG. 5, the clutch 40 includes a boss 41 and a pusher 42. The boss 41 extends from the second face of the fin 34. The pusher 42 extends from the same face of the sliding element 54 as the fin 56 (FIG. 10). The pusher 42 includes a recess 43 and a ramp 44.

Referring to FIGS. 1, 4 and 7, the fin 56 is located against and movable along the rib 113. The fin 57 is located against and movable along the rib 128. The track 127 is located in the groove 58. The barb 59 abuts against a shoulder (not numbered) formed on the track 127 to keep the track 127 in the groove 58. Thus, the sliding element 54 is smoothly movable toward and from the holder 30.

Referring to FIGS. 1 through 4, the lever 60 includes a lug 61 at an end and an arched face 62 at an opposite end so that the lever 60 is shaped like a sector. The lug 61 is provided around a pivot 611 extending from the internal face of the shell 12 so that the lever 60 is rotatable about the pivot 611 in the first lower slot 22 of the handle 20. The arched face 62 is formed with two bores 63 and 64 and a spring-supporting portion 65.

An arched element 66 includes two portions inserted in the rear slots 24 and 25 of the handle 20 to keep the arched element 66 in position relative to the handle 20. An opening 661 is made by and between another portion of the arched element 66 and the rear end 17 of the handle 20. The opening 661 can receive a portion of a loop (not shown) that can be hung on a nail or a hook attached to a wall for example.

The spring 67 includes a portion inserted in a groove 671 in the internal face of the shell 12. The groove 671 is preferably made by and between two strips (not numbered) extending from the internal face of the shell 12. An end of the spring 67 is in contact with an end of the arched element 66 and another end of the spring 67 is in contact with the spring-supporting portion 65 of the lever 60. The spring 67 is compressed between the end of the arched element 66 and the spring-supporting portion 65 of the lever 60. The compression spring 67 bias the lever 60 so that a portion of the lever 60 is located out of handle 20 via the first lower slot 22.

A safety switch 80 is inserted in the second lower slot 23 of the handle 20. The safety switch 80 includes a bolt 81. The safety switch 80 is movable between a locking position and an unlocking position. When the safety switch 80 is in the locking position, the bolt 81 is inserted in the bore 64 to prevent the lever 60 from pivoting relative to the handle 20. Hence, the lever 60 cannot be pivoted to extend the pointed end 74 of the blade 70 from the handle 20 as indicated by an arrow head 15 (FIG. 3).

Figure 11:
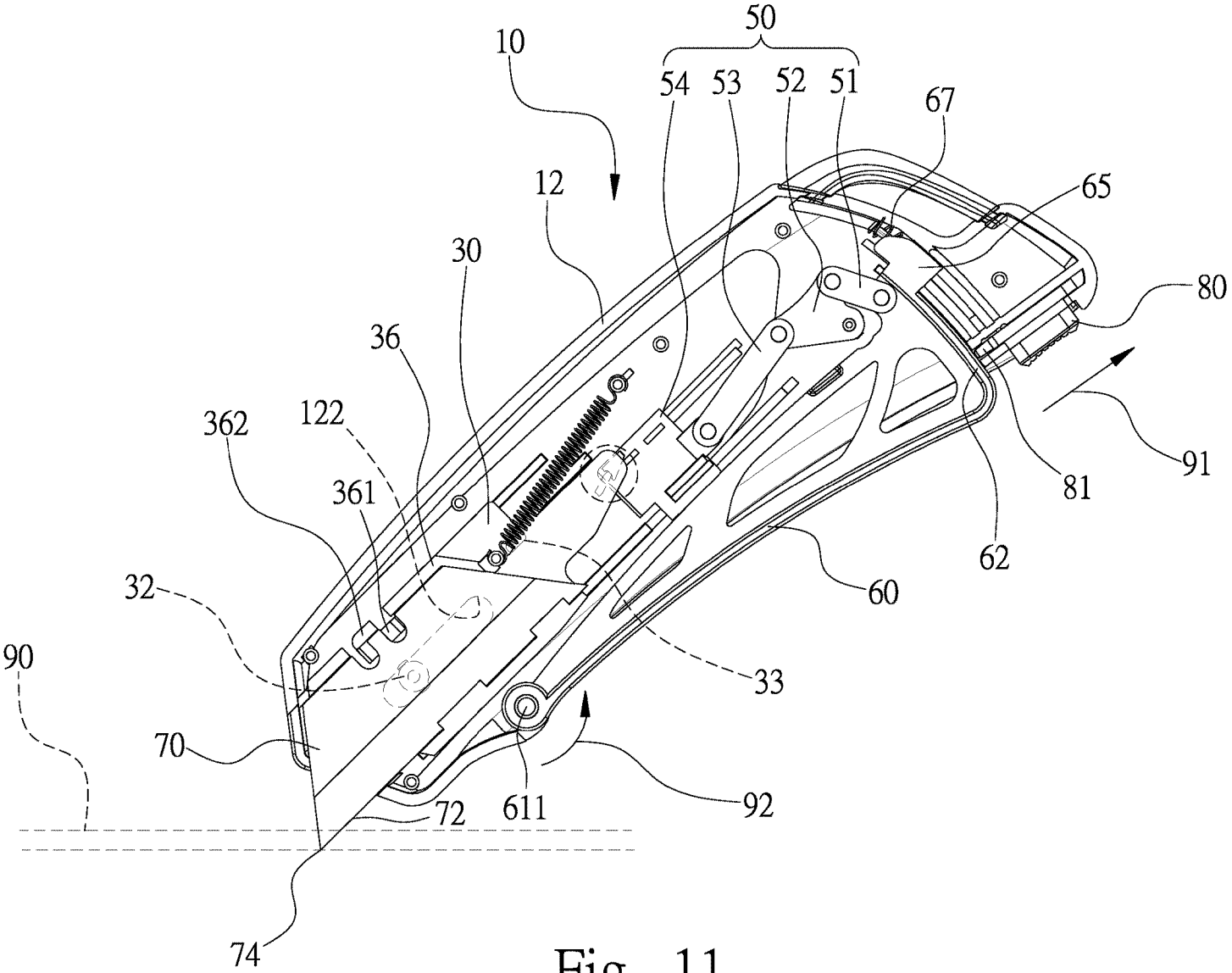
FIG. 11 is a side view of the shell and related elements in another position than shown in FIG. 4.
Figure 12:
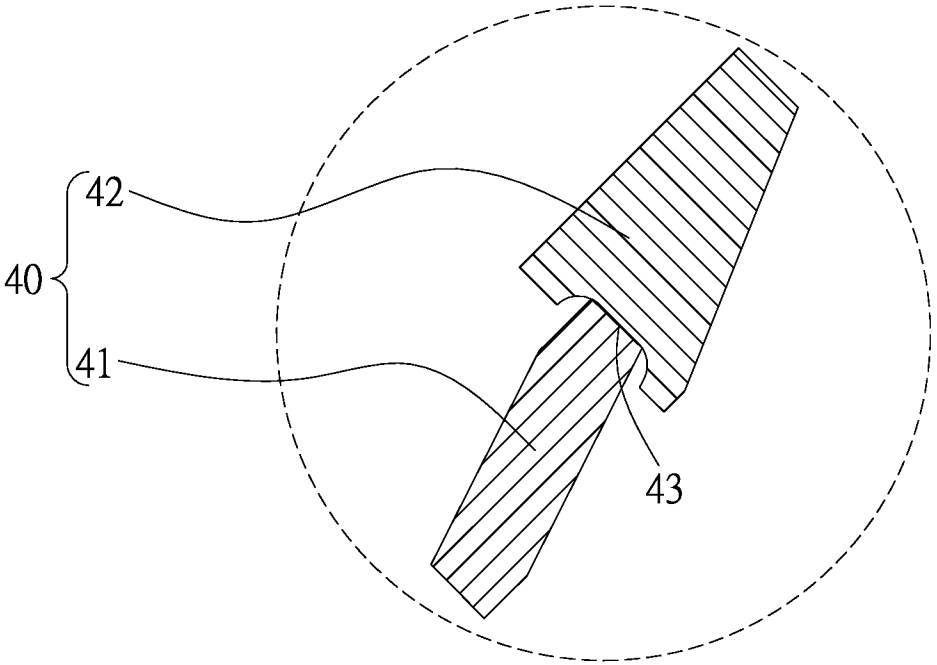
FIG. 12 is a cross-sectional view of the clutch in another position than shown in FIG. 5.

Referring to FIGS. 11 and 12 as indicated by an arrow head 91, the safety switch 80 is moved to the unlocking position to move the bolt 81 from the bore 64 to allow the lever 60 to pivot relative to the handle 20. An external force is used to pivot the lever 60 about the pivot 611 as indicated by an arrow head 92. Thus, the spring-supporting portion 65 further compresses the spring 67. The rocking elements 51 pivot the connecting elements 53 via the crank 52. The connecting elements 53 move the sliding element 54 toward the holder 30. The recess 43 easily receives the boss 41 to cause the pusher 42 to effectively push the boss 41 as the block 33 is abutted against the stopping strip 126 to keep the boss 41 in front of and at a same level with the pusher 42. The sliding element 54 moves the holder 30 in a rectilinear manner as the groove 122 guides the pivot 32. Hence, the pointed end 74 of the blade 70 is extended from the handle 20 via the front slot 21. A front portion of the cutting edge 72 in the vicinity of the pointed end 74 cuts into an article 90.

Figure 13:
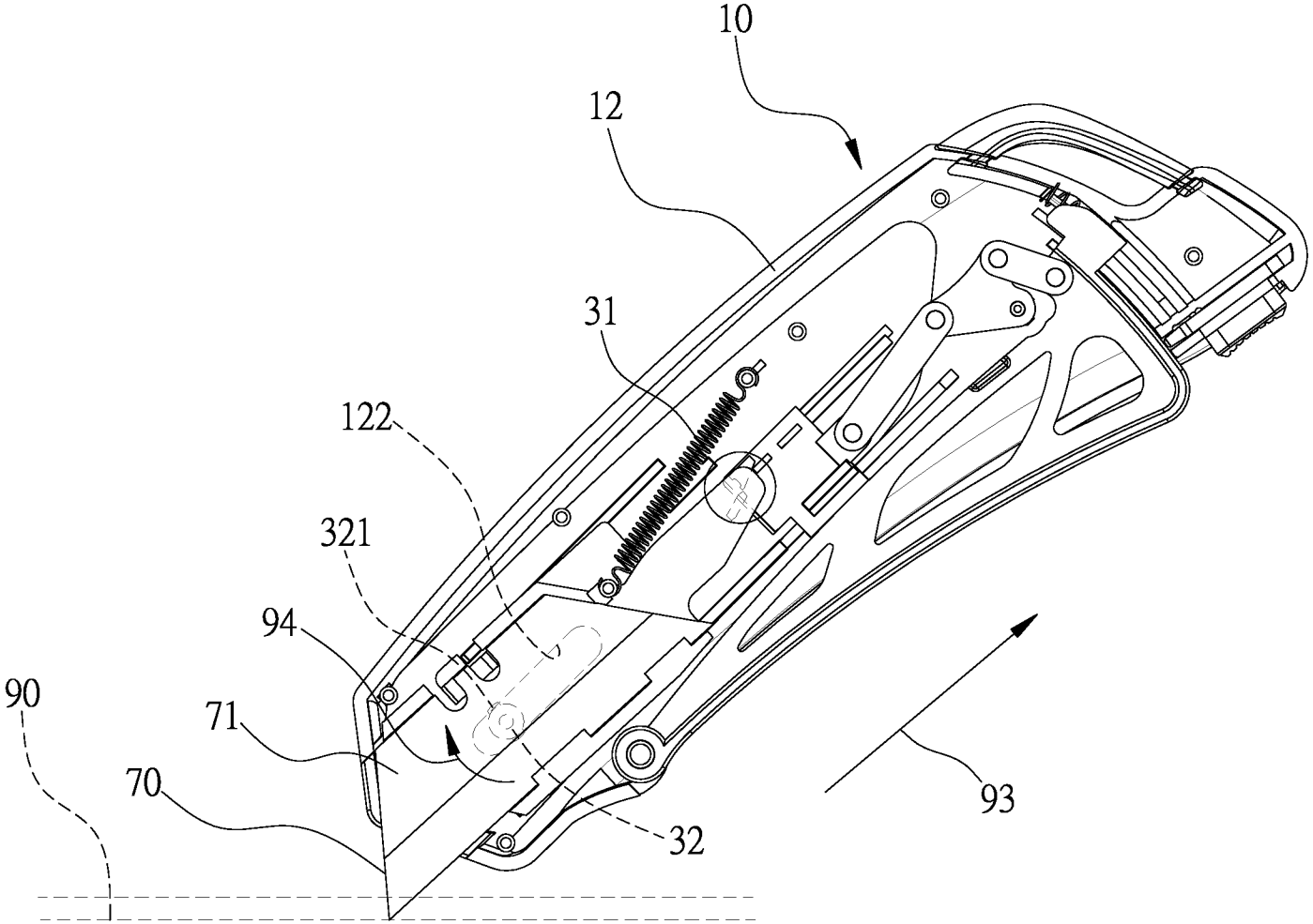
FIG. 13 is a side view of the shell and related elements in another position than shown in FIG. 11.
Figure 14:
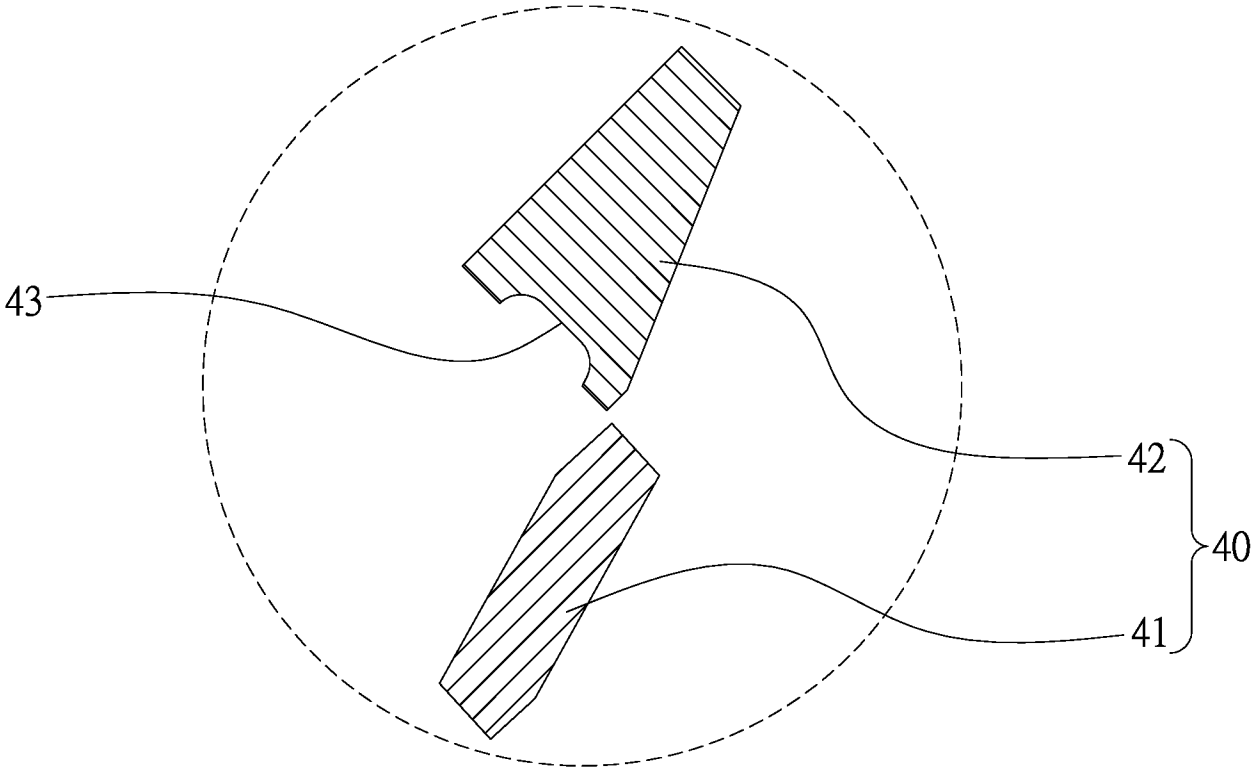
FIG. 14 is a cross-sectional view of the clutch in another position than shown in FIG. 12.

Referring to FIGS. 13 and 14, the external force is still exerted on the lever 60, and the box cutter 10 is moved relative to the article 90 as indicated by an arrow head 93. The front portion of the cutting edge 72 is kept in the article 90 because of friction between the front portion of the blade 70 and the article 90. The holder 30 is moved toward the front end 16 of the handle 20 so that the spring 31 is further extended.

As indicated by an arrow head 94, the blade 70 is pivoted relative to the handle 20 so that a length of the blade 70 is not parallel to a length of the handle 20. Accordingly, the holder 30 is pivoted about the pivot 32 so that the boss 41 is moved from the recess 43, i.e., the boss 41 is not abutted against the pusher 42 and the holder 30 is disengaged from the sliding element 54. More particularly, an upper face of the boss 41 is located below the ramp 44 of the pusher 42. Synchronously, the spring 31 is further extended.

As discussed above, the barbs 321 are abutted against the flange 129 to retain the pivot 32 in the groove 122. Thus, the pivot 32 is still guided by the groove 122, and the holder 30 is still connected to the shell 12.

Figure 15:
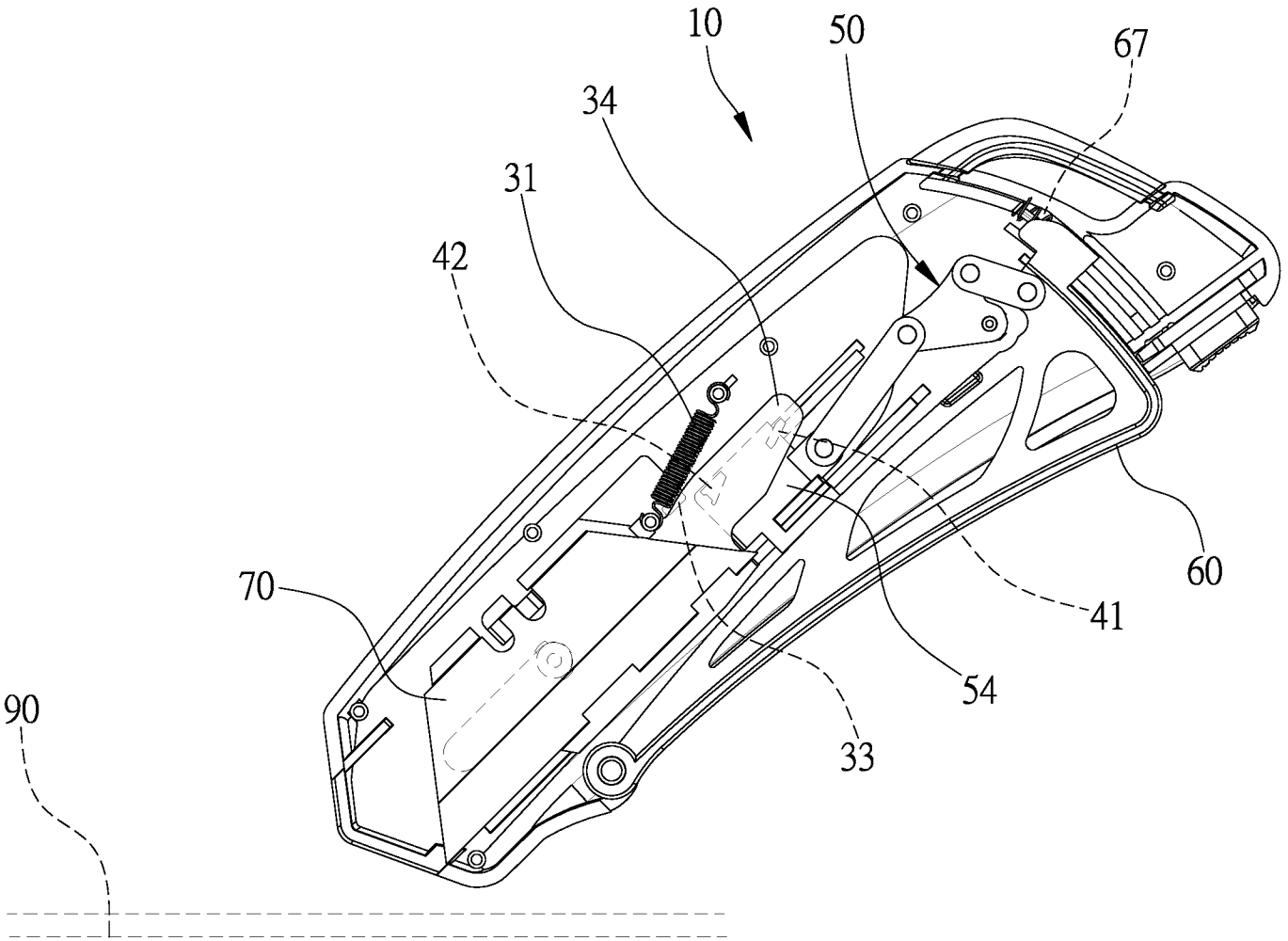
FIG. 15 is a side view of the shell and related elements in another position than shown in FIG. 13.
Figure 16:
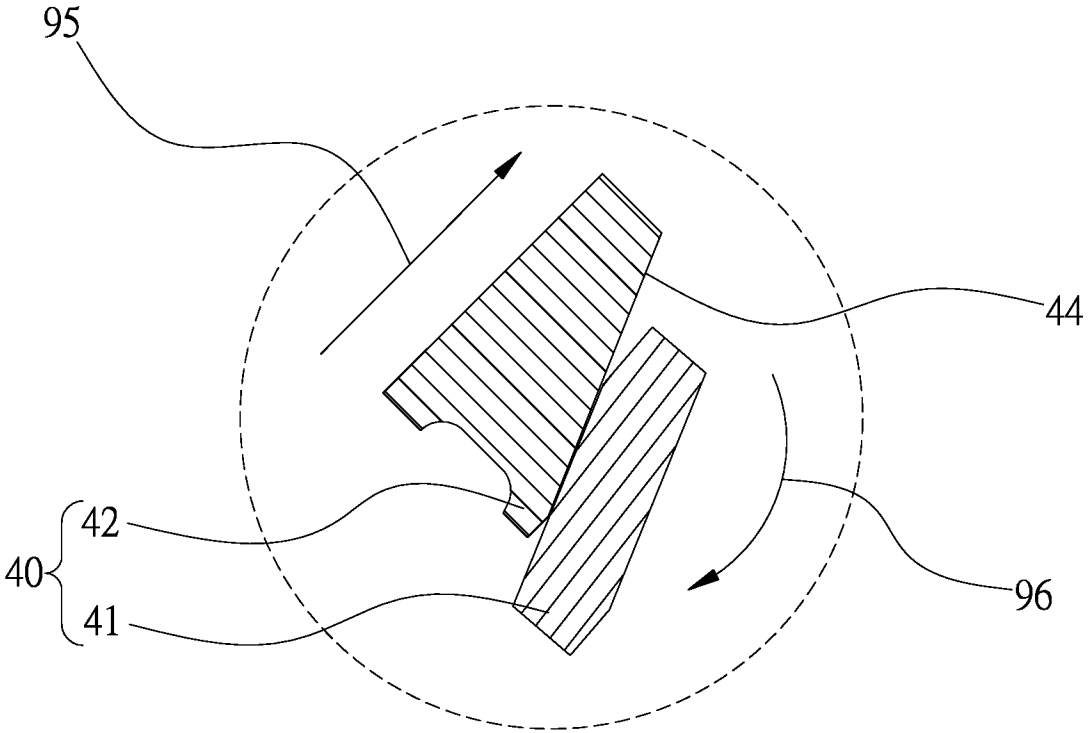
FIG. 16 is a cross-sectional view of the clutch in another position than shown in FIG. 14.
Figure 17:
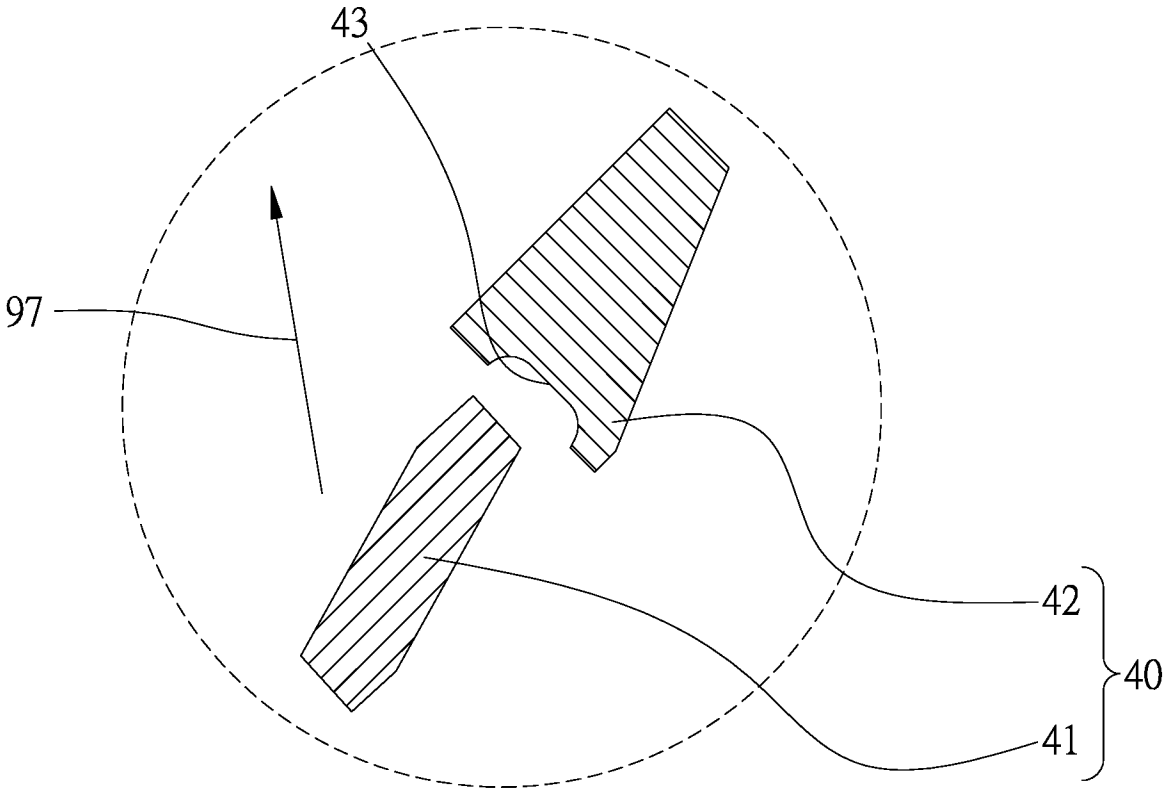
FIG. 17 is a cross-sectional view of the clutch in another position than shown in FIG. 16.

Referring to FIGS. 15 through 17, the external force is still exerted on the lever 60, but the front portion of the cutting edge 72 of the blade 70 is moved from the article 90. As mentioned above, the boss 41 is not abutted against the pusher 42 so that the spring 31 is allowed to translate and pivot the holder 30. The spring 31 translates the holder 30 toward the rear end 17 of the handle 20, i.e., deeper into the handle 20. Accordingly, the boss 41 is moved rearward from the pusher 42 so that the boss 41 is located behind the pusher 42. The spring 31 pivots the holder 30 so that the block 33 is abutted against the stopping strip 126 again (FIG. 4). The pusher 42 is in front of the boss 41 since the lever 60 still compresses and prevents the spring 67 from moving the linkage 50.

Then, the lever 60 is released from the external force to allow the spring 67 to return the lever 60 and the linkage 50 into their original positions (FIG. 4). Referring to FIG. 16, the pusher 42 is moved as indicated by an arrow head 95. Referring to FIG. 16, the ramp 44 of the pusher 42 slides on the upper face of the boss 41 and the pusher 42 pushes the boss 41 to pivot the fin 34, including the boss 41, as indicated by an arrow head 96. Thus, the pusher 42 is finally moved past the boss 41.

Referring to FIG. 17, the boss 41 is allowed to move as indicated by an arrow head 97. Thus, the boss 41 is again in front of the recess 43 of the pusher 42. The box cutter 10 is ready for another round of operation. The direction indicated by the arrow head 97 is the length of the spring 31 as shown in FIG. 15.

To replace the blade 70 with a new one, the lever 60 is pivoted to the position shown in FIG. 11. In a direction opposite to the direction indicated by the arrow head 91, the safety switch 80 is moved so that the bolt 81 is inserted in the bore 63 of the arched face 62 (FIG. 1 or 2). The button 18 is pushed into the shell 11 (FIG. 3) to push the driving portion 362 toward the shell 12, thereby pivoting the elastic leaf 36 relative to the remaining portions of the holder 30 and releasing the blade 70 from the locking portion 361. The blade 70 is removed from the holder 30 and replaced with the new one. The button 18 can be released, and so is the driving portion 362. The elastic leaf 36 is returned to its original position so that the locking portion 361 is inserted in a selected one of the cutouts 75 of the blade 70.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A box cutter comprising:

a handle comprising a space and a front slot in communication with the space;

a blade comprising a front section and a rear section;

a holder formed with a boss and operable for holding the rear section of the blade; and a linkage comprising a sliding element formed with a pusher;

wherein the holder is configured to translate between a front position and a rear position in the space, wherein the holder translates toward the front slot while translating to the front position;

wherein the front section of the blade extends from the space via the front slot when the holder is in the front position;

wherein the holder is configured to pivot between a first angle and a second angle in the space;

wherein the sliding element is movable in the space toward the front slot to abut the pusher against the boss to move the holder to the front position when the boss is located between the front slot and the pusher and the holder is located at the first angle;

wherein when the front section of the blade extends from the space via the front slot and is pressed against an external article, the holder is pivoted to the second angle to move the boss from the pusher;

wherein when the blade is moved from the external article, the holder is configured to return to the rear position and the first angle due to the movement of the boss from the pusher;

wherein the pusher is configured to move from the front slot past the boss when the holder is in the rear position to locate the boss between the front slot and the pusher again.

2. The box cutter according to claim 1, wherein the holder comprises a fin formed thereon, and the boss is formed on the fin.

3. The box cutter according to claim 1, wherein the pusher comprises a recess for receiving the boss to render firm the abutment of the pusher against the boss.

4. The box cutter according to claim 1, wherein the pusher comprises a ramp for sliding against the boss to allow the pusher to move past the boss.

5. The box cutter according to claim 1, further comprising a spring comprising an end connected to the handle and another end connected to the holder for returning the holder to the rear position and the first angle.

6. The box cutter according to claim 1, further comprising a lever pivotally connected to the handle at an end and pivotally connected to the linkage at another end so that the sliding element is moved toward the front slot when the lever is pivoted toward the handle.

7. The box cutter according to claim 6, further comprising a spring compressed between the lever and the handle to pivot the lever from the handle, thereby moving the sliding element from the front slot.

* * * * *